US005735482A

United States Patent [19]

Kuzik

[11] Patent Number: 5,735,482

[45] Date of Patent: Apr. 7, 1998

[54] APPARATUS AND METHOD FOR WINDING, TRANSPORTING, AND UNWINDING CONVEYOR BELTS

[76] Inventor: Larry J. Kuzik, 7576 Morrison Cr., Langley, B.C., Canada, V3A 6Y3

Related U.S. Application Data

[60] Provisional application No. 60/000,670, Jun. 30, 1995.

[21] Appl. No.: 588,557

[22] Filed: Jan. 18, 1996

[51] Int. Cl.[6] ..... B65H 18/10; B65H 75/06

[52] U.S. Cl. ..... 242/537; 242/613.3; 198/844.2

[58] Field of Search ..... 242/537, 557, 242/613.3, 403; 198/812, 844.2

[56] References Cited

U.S. PATENT DOCUMENTS

| | | | |
|---|---|---|---|
| 2,105,707 | 1/1938 | Stancliff | 242/537 |
| 3,727,751 | 4/1973 | Bloch et al. | 242/613.3 X |
| 4,063,691 | 12/1977 | Bacvarov | 242/613.3 |
| 4,195,726 | 4/1980 | Denny et al. | 242/557 |
| 4,208,022 | 6/1980 | Wimberly | 198/812 |
| 5,188,218 | 2/1993 | Kuzik | 198/812 |
| 5,201,406 | 4/1993 | Kellis | 198/812 |

FOREIGN PATENT DOCUMENTS

| | | | |
|---|---|---|---|
| 246406 | 4/1912 | Germany | 242/537 |
| 1134273 | 8/1962 | Germany | 242/537 |

*Primary Examiner*—John M. Jillions
*Attorney, Agent, or Firm*—Robert B. Hughes

[57] ABSTRACT

A method of winding a length of a conveyor belt onto a support structure which is delivered to the location where it is to be used, and then unwound. The length of conveyor belt is then spliced to other lengths of conveyor belt to form a continuous conveyor belt. The particular support structure has an elongate configuration so that when the belt is wound on the support structure, it extends along a winding path that has 180° curves at opposite ends, these being joined by upper and lower straight path sections parallel to the longitudinal axis of the support structure. The use of this support structure, as well as the method of the present invention, provide greater efficiency and savings. Specifically, usually belt sections of greater lengths can be shipped, thus reducing costs of splicing the belt sections at the end location, as well as other advantages.

13 Claims, 5 Drawing Sheets

APPARATUS AND METHOD FOR WINDING, TRANSPORTING, AND UNWINDING CONVEYOR BELTS

This application claims the priority date of the previously filed Provisional Application No. 60,000,670, filed Jun. 30, 1995 entitled "APPARATUS AND METHOD FOR WINDING, TRANSPORTING, AND UNWINDING CONVEYOR BELTS", naming Larry Kuzik as the inventor.

BACKGROUND OF THE INVENTION a) Field of the Invention

The present invention relates generally to conveyor belts, particularly conveyor belts which are used for large scale operations such as mining, where sections of the conveyor belt are shipped to the location of use and then spliced together to form a conveyor belt system.

b) Background Art

In mining operations, for example, it is quite common for very large conveyor belts to be used to carry the ore that is being mined a rather long distance (up to a half a mile or more), and also to carry the ore to a higher elevation (e.g. a thousand or more feet). Commonly, the body of such conveyor belts are made of a hard moderately flexible rubber material which is reinforced by a plurality of elongate steel cables which extend longitudinally at laterally spaced locations within the body of the belt. Also, the belts can have woven fabric material that is used singularly or plurally in layers as the reinforcing tension member.

As a practical matter, it is necessary to manufacture the belt in sections, and then ship these sections of belts to the use location, (e.g. the mining site). Then the belt sections are spliced together by having the steel cables of the belt placed to overlap with one another, and then embedding these in the rubber like material to complete the splice. Or the fabric layers are stepped, skived, or fingered and embedded in the rubber like material to complete the splice.

A common prior art way of shipping the conveyor belt section is to first wind the conveyor belt on a cylindrical spool, and then load this spool onto a flatbed truck, trailer or other vehicle to be carried to the site where it is assembled into a complete belt. Thus, at the location of manufacture, the belt is first wound onto the spool, and after being shipped is simply unrolled from the spool to be joined into the final continuous conveyor belt. If more than one roll is required, they are unrolled and joined together at the site of use to form the continuous conveyor belt, and then placed on the conveyor.

Another manner of accomplishing this is to provide rotating spools and wind one half of the belt onto one spool in a spiral configuration, and the other half of the belt onto another, with the belt interconnecting between the two spools. Thus, the belt is wound on two spools in substantially the same manner as an audio tape is wound on two spools in a tape cassette. After the belt is shipped, to unwind the belt, it is generally necessary to wind the total belt section onto one of the spools to obtain a free end, after which the belt is then unwound as it is placed on the conveyor belt support members.

SUMMARY OF THE INVENTION

The present invention relates to a method and apparatus to accomplish the winding, shipping and unwinding of belt lengths of a conveyor belt or the like. The present invention is particularly adapted to solve certain problems associated with the shipping of large conveyor belts, having substantial length dimensions, from a factory location or other location to the area of use, and particularly under circumstances where there are shipping size and weight restrictions, safety considerations, and also where belt lengths must be spliced together to form the continuous conveyor belt. In the method of the present invention, there is first provided a belt support structure comprising:

1. a first end section at a first end of the support structure having a first transverse center axis and having a first end support portion defining a first belt support area that extends around said first transverse axis in approximately a 180° curve;
2. a second end section at a second end of the support structure having a transverse center axis and having a second end support portion defining a second belt support area that extends around said second transverse axis in an approximate 180° curve;
3. a longitudinally aligned intermediate section extending between and interconnecting said first and second end sections in defining upper and lower belt support areas generally parallel to the longitudinal axis;
4. the first, second and intermediate sections of the support structure collectively defining a continuous winding path.

The belt support structure is then rotated around an axis of rotation relative to the belt length to wind the belt length along the belt winding path onto the belt support structure, where the belt winding path comprises:

1. a first end path section extending in an approximate 180° curve around the first belt support area;
2. a second end path section extending in an approximate 180° curve around the second belt support area;
3. an upper intermediate path section extending along the upper belt support area generally parallel to the longitudinal axis between upper ends of the first and second path sections;
4. the lower intermediate path section extending along the lower belt support area generally parallel to the longitudinal axis between lower ends of the first and second path sections.

Then the belt structure with the belt length wound thereon is moved to another location, after which the belt length is unwound from the belt support structure.

Also, in a common application of the present invention, there is a plurality of belt lengths which are wound onto respective belt support structures. The method further comprises moving the belt lengths wound on their respective support structures to the location, unwinding the belt lengths from their respective support structures, and then connecting the belt lengths to one another to form the conveyor belt. Under circumstances where the belt length is shipped by shipping means that has length and height restrictions, the method further comprises providing the support structure so that the first and second transverse center axes are spaced from one another by a predetermined distance. The belt length is wound onto the support structure to a predetermined winding depth measured from the first and second transverse axes radially outwardly, in a manner that the belt length and the support structure, forming a shipping unit, have length and height dimensions within the shipping limits.

More specifically, where a maximum length of the shipping restrictions is "x", and a load height dimension to meet the height shipping restrictions is "y", the winding thickness is "t", and the distance between the first and second transverse axes is "d", the winding thickness is such so that "2t" is no greater "y", and the spacing distance "d" is selected so that "d" plus "2t" is no greater than "x".

Desirably, the belt length is wound onto the belt structure by mounting the belt support structure to a winding apparatus for rotation about an axis of rotation extending transversely across the belt support structure. The belt support structure is rotated about the axis of rotation while the belt support structure is mounted to the winding structure. The belt is unwound in generally the same manner as the belt is wound onto the winding structure, except that the direction of rotation is reversed.

Considering that the support structure with the belt lengths thereon comprises a shipping unit, the shipping unit desirably has a lower support surface means extending both longitudinally and transversely across the shipping unit to provide a substantially planar support surface, whereby the shipping unit can be placed on a support surface of a shipping apparatus and be stable.

In one preferred form, the belt support structure comprises a pair of side frame sections which extend along the belt winding path so that the belt length is at least partially contained within portions of the frame sections, and the side frames at least in part form said support surface means. Also in a preferred form, the two frame structures comprise at least in part a truss like structure.

In one form of the invention, at least one of the first and second end sections has its related end support portion adjustable longitudinally so that a distance between the first and second transverse center axes can be adjusted.

The support structure of the present invention is constructed as described above, and as shown in the preferred embodiments, forms a substantially unitary structure.

Other features of the present invention will become apparent from the following detailed description.

DESCRIPTION OF THE PREFERRED EMBODIMENTS

Figure 1:
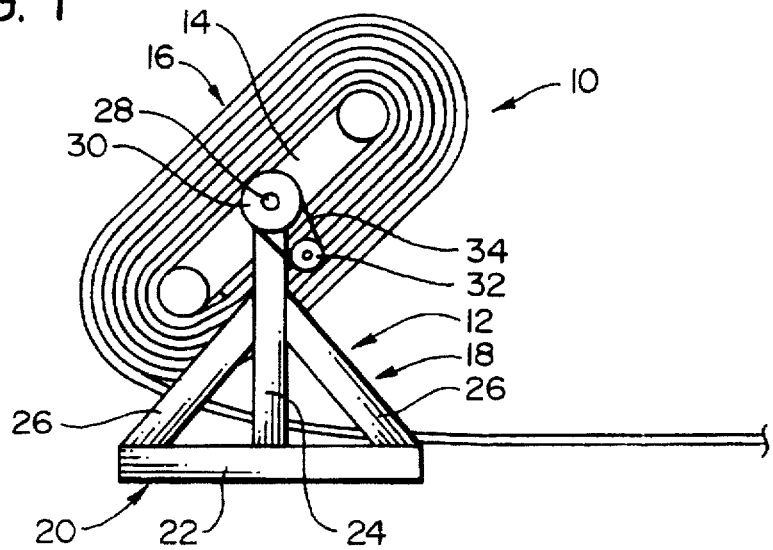
FIG. 1 is a side elevational view of the apparatus of the present invention, showing the belt section being wound onto a spool member of the present invention.

In FIG. 1, there is shown the combination 10 of the present invention which comprises a winding or unwinding stand 12, a spool assembly 14 and a section 16 of conveyor belt partially wound on the spool assembly 14 (also called a belt support and shipping assembly).

The stand 12 comprises right and left laterally spaced stand sections 18, each of which has a base 20 comprising (in this particular configuration) a horizontal ground engaging base member 22 having a post 24 standing therefrom, with the post being braced by two diagonals 26. The other frame section 18 is substantially the same as the one shown in FIG. 1.

At the upper end of the support frame 12, there is a shaft 28 which is mounted to the post 24 and fixedly engaged to a drive wheel 30 which is in turn driven from a motor 32 interconnecting with the drive wheel 30 by means of a drive belt 34. The shaft 28 in turn extends through and is engaged with the center portion of the spool assembly 14 so that rotation of the shaft 28 causes rotation of the spool assembly 14.

Figure 3:
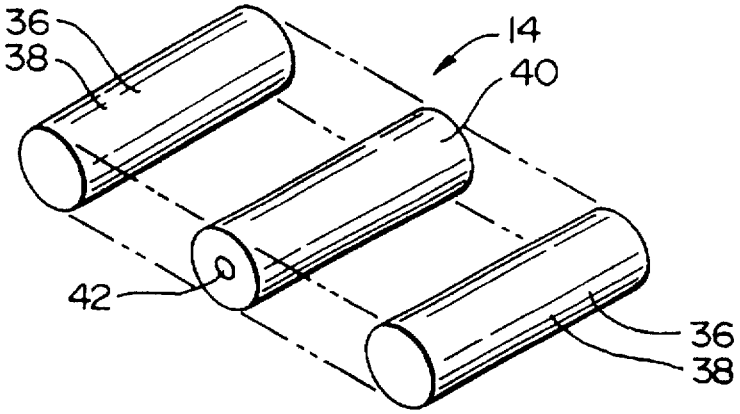
FIG. 3 is a somewhat schematic view illustrating the three spool elements which are the basic functional components of the spool assembly of the present invention.

Reference is now made to FIG. 3 which shows the spool assembly 14 somewhat schematically. There are two end spool support members 36 provided in the form of cylindrical spools, each having an outer semi-circular cylindrically curved winding surface 38. Then there is a center support member 40, provided in the form of a cylindrical spool, having a center through opening 42 to receive the aforementioned shaft 28.

Figure 4:
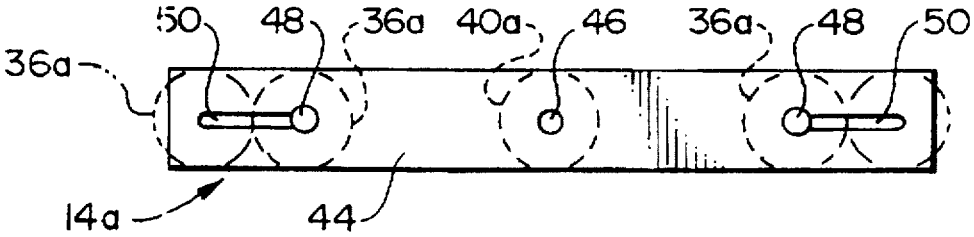
FIG. 4 is a first embodiment of the present invention where the three spool elements are adjustably mounted to laterally spaced elongate beams.

FIG. 4 shows a first embodiment of the spool assembly 14, this being designated **14*a*. There is shown in FIG. 4 in side elevation one of two longitudinally extending beams 44. Each beam 44 has a center opening 46 to receive the shaft for a center mounting member 40*a*. The two end support members 36*a* each have at each end a trunion member 48 by which the support member or spool can be mounted to longitudinally extending slots 50 in the adjacent ends of the two beams 44. Thus each support member or spool 36*a* can have its longitudinal position spaced either closer to or further from the center support member or spool 40*a*. This enables the belt section 36** to be wound in shorter or longer lengths.

Figure 5:
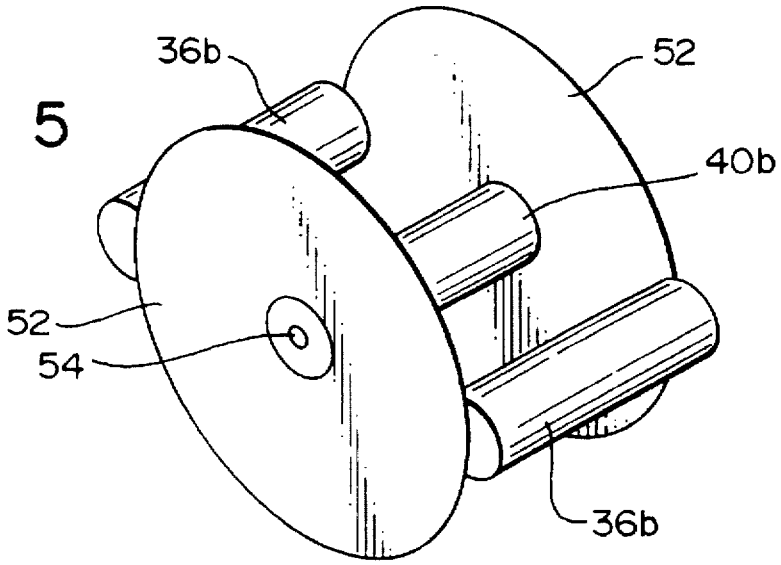
FIG. 5 is a second embodiment of the present invention where the spool elements are mounted to two disk-like members.

A second embodiment is illustrated in FIG. 5, and components of this second embodiment similar to those of the embodiment of FIG. 4 will be given like numerical designations with a "b" suffix distinguishing those of this second embodiment. There is, as in the first embodiment, the center support member **40*b* and the two end support members 36*b*. The center support member 40*b* is mounted to the center of two laterally spaced mounting disks 52**.

The two end support members **36*b* are fixedly connected between peripheral edge portions of the two disks 52 at positions diametrically opposed from the center support member 40*b*. The center support member 40*b* has a center opening 54** to receive the mounting shaft.

Figure 6:
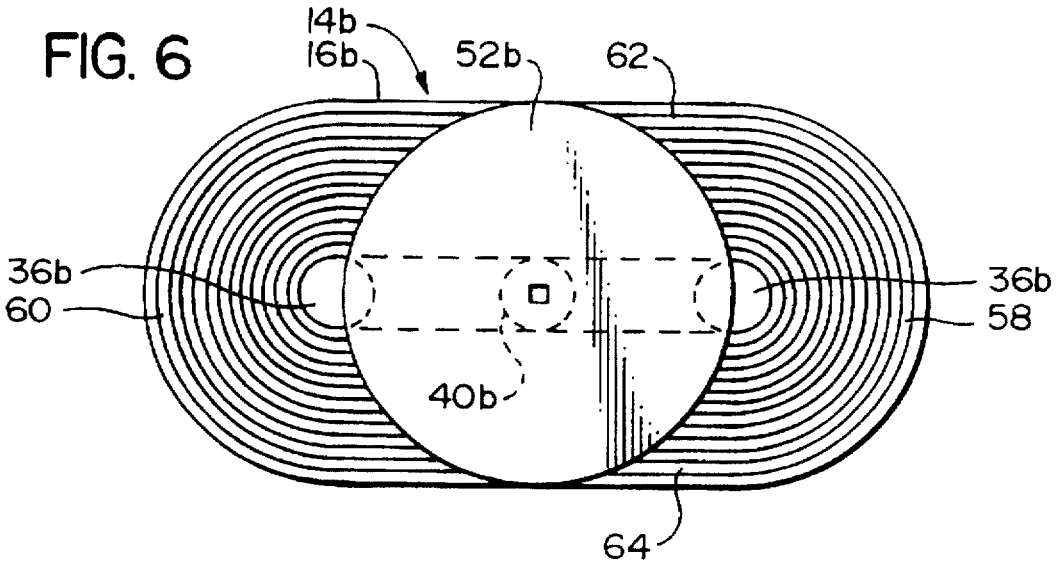
FIG. 6 is a side elevational view showing the embodiment of FIG. 5, with the belt section wound thereon.

FIG. 6 illustrates the second embodiment of FIG. 5 in side elevation, showing the belt section 16*b* being wound onto the spool assembly 14*b*. It can be see that with the belt being wound onto the spool assembly 14*b*, the belt section can be considered as having four portions in its wound position. First, there are two end portions 58 and 60 which are made up of layers of the belt section 14*b* extending around the related spool 36*b* in a semi-circular curve. Then there are upper and lower belt sections 62 and 64, respectively, which are made up of layers of the belt section extending in a straight line planar configuration between the end sections 58 and 60.

Figure 7:
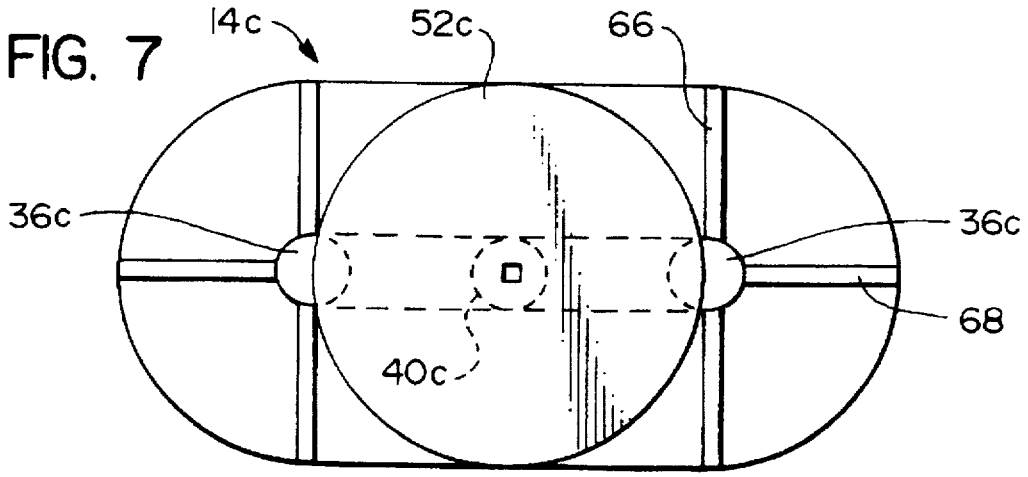
FIG. 7 illustrates a third embodiment of the present invention.

FIG. 7 shows a third embodiment, where components similar to the prior two components will be given like numerical designations with a "c" suffix distinguishing those of the third embodiment. As in the second embodiment, there are the three support members 40*c* and 36*c* mounted to the two side disks 52*c*. Then there is at each end of the spool assembly 14*c* two sets of containing arms or positioning arms, two of which are extending from the end spool 36*c* at right angles to the longitudinal axis of the spool assembly 14*c*, these two arms being designated 66. There is a third arm extending longitudinally and outwardly from each end support member 36*c*, this arm being designated 68.

Figure 8:
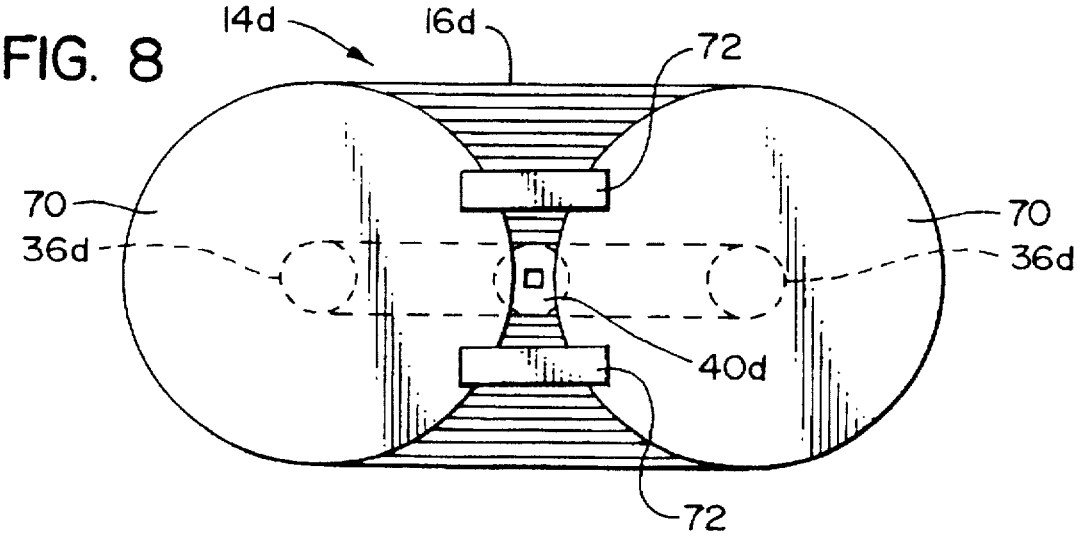
FIG. 8 illustrates a fourth embodiment of the present invention.

A fourth embodiment is illustrated in FIG. 8, where components which are similar to the prior embodiments will be given like numerical designations with a "d" suffix distinguishing those of this fourth embodiment. There are the three support members 36*d* and 40*d*. Each end support member 36*d* is fixedly mounted to an end disk 70, there being two such end disks 70 on each side of the spool assembly 14*d*. Each pair of two disks 70 are fixedly interconnected to one another in a suitable manner, the connection means being shown somewhat schematically by the two sets of two connecting bars 72 (only one set being shown) interconnecting each pair of the two disks at 70. It can be seen that when the belt section 16*d* is wound onto the spool assembly 14*d* the two pair of disks 70 perform an alignment function, and also protect the end side portions of the belt section 16*d*.

To describe now the method of the present invention, reference is made to FIGS. 2A through 2D. Let us assume that the belt section has been manufactured at the factory location, and it is now necessary to wind the belt section 16 on to the spool assembly 14. One end 74 of the belt section 16 is removably attached to one of the end support members 36 of the spool assembly 14 which is rotatably mounted to the frame 12. Then the spool assembly 14 is rotated by suitable drive means in a clockwise direction so that successive portions of the belt 16 are caused to be wound in a straight line portion between the two end support members 36 and then in a 180° curve to then form a subsequent straight of wound belt section, with this winding process being continued.

Figure 2A:
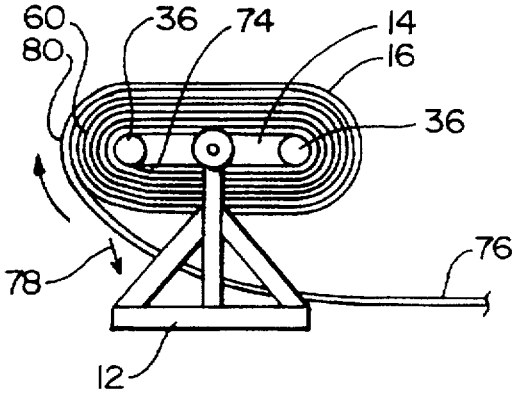
FIGS. 2A, 2B, 2C and 2D are a series of views similar to FIG. 1, showing the sequence of winding (and unwinding) the belt onto the spool.

In FIG. 2A, the belt section 16 is being wound in a manner so that an unwound belt section 76 is at a lower ground location. Thus there is on the belt 16 a combined gravitational force and drag force which is indicated somewhat schematically by the arrow 78. It can be seen that this force causes the curved outer belt portion at 80 to be pulled rather tightly around the adjacent end belt location 60.

Figure 2B:
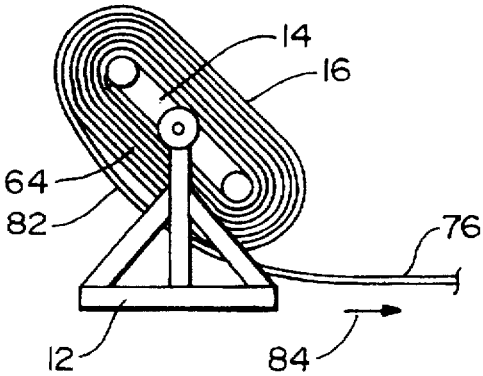

As the spool assembly 14 rotates 45° from the position of FIG. 2A to the position of FIG. 2B, it can be seen that a portion 82 of the belt is now moving into a position adjacent to the belt portion 64. The unwound belt portion 76 still has a drag force which is represented by the arrow 84. Thus, the unwound belt section 76 is still exerting a drag force illustrated in FIG. 2B at 84. This causes the belt portion 82 to be pulled taut against the adjacent belt portion 64.

Figure 2C:
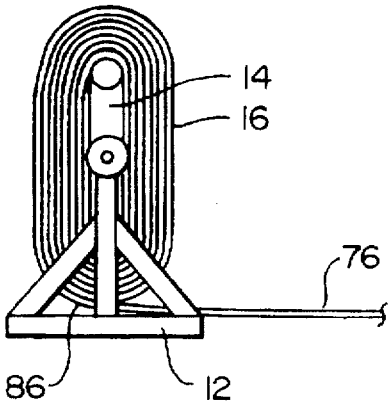
Figure 2D:
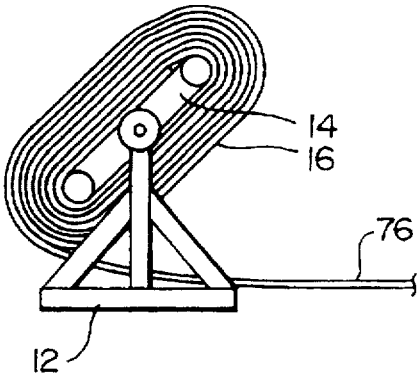

When the belt section 16 has moved 45° further to the position of FIG. 2C, the unwound belt section 76 is still pulled taut so that the lower circularly curved belt portion 86 is pulled tight. With the spool assembly 14 rotating a further 45° to the position of FIG. 2D, the belt is moving into the position where the winding cycle of the belt, as seen in FIG. 2A, begins repeating itself.

Figure 9:
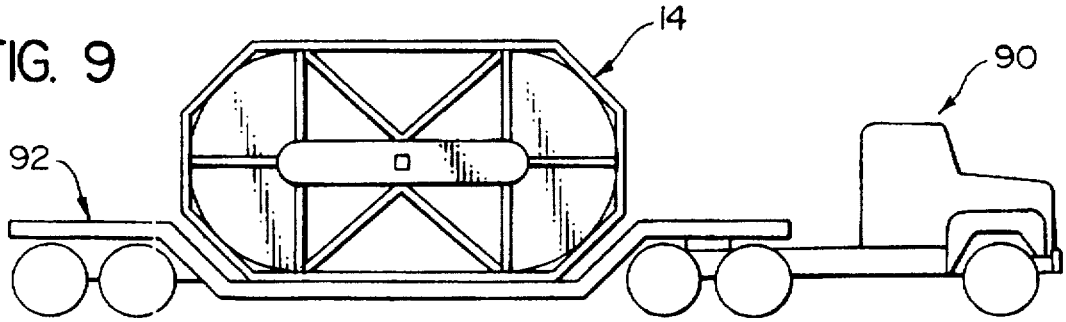
FIG. 9 illustrates a belt section, wound on a spool assembly of the present invention and loaded on a flatbed trailer for shipment.

When the belt section is totally wound onto the spool assembly 14, the free end of the belt is secured in some manner, and then a crane or other suitable lifting device engages the spool assembly 14 in a suitable manner to lift the spool assembly 14 with the belt section 16 wound thereon. Then this is loaded onto suitable transportation vehicle, such as the truck 90 having a "low boy" trailer, as shown in FIG. 9.

When the truck and trailer 90/92 arrives at the destination, a crane is used to lift the spool assembly 14 and the belt section 16 off of the truck and deposit these in the operating position on the frame 12 which is already at that destination. Then the belt section 16 is unwound from the spool assembly 14 by pulling the unwound belt section 76. It has been found that the belt can be unwound very easily in a continuous fashion.

Figure 10:
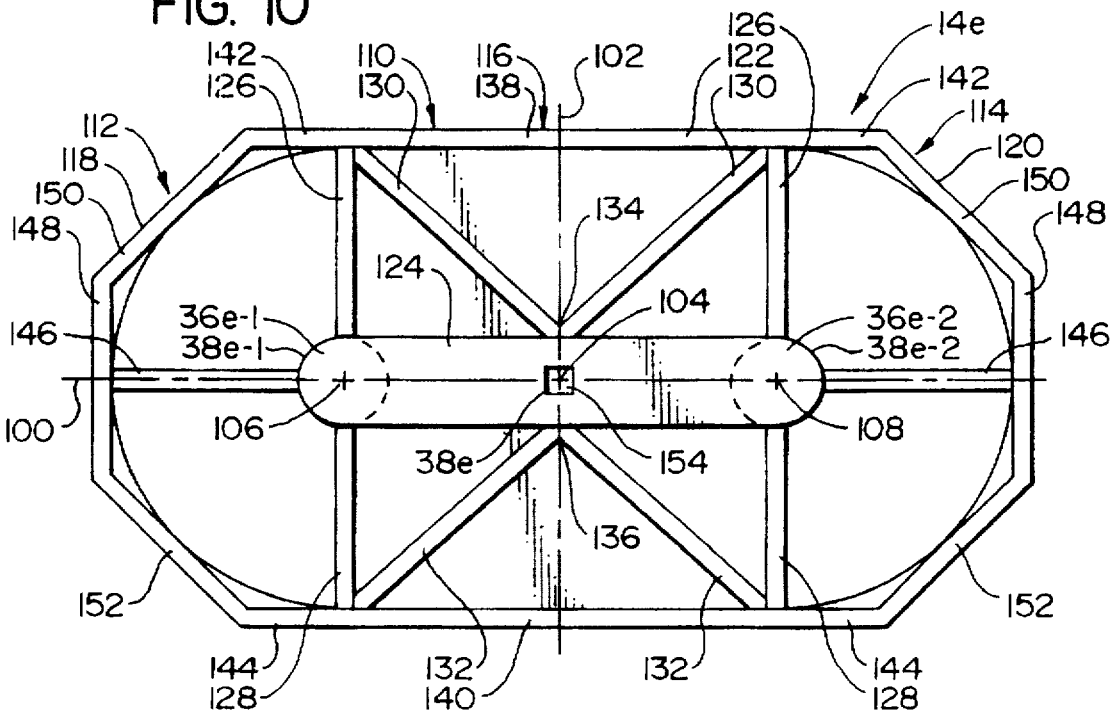
FIG. 10 is a side elevational view of a fifth embodiment of the present invention.

A fifth embodiment is illustrated in FIG. 10. Some of the components of this fifth embodiment which are similar to Components of the earlier embodiments will be given like numerical designations with an "e" suffix distinguishing those of the fifth embodiment. This fifth embodiment is presently believed to be a more preferred embodiment for practical commercial use.

There is a belt support and shipping assembly 14*e* having a longitudinal center axis 100, a vertical center axis 102, and a center transverse axis 104 which in FIG. 10 is perpendicular to the surface on which FIG. 10 is displayed. In addition, there are first and second transverse end axes 106 and 108, respectively.

There are first and second transversely extending end support members 36*e*, 36*e*-1 and 36*e*-2, each having an outer curved support surface 38*e*-1 and 38*e*-2, respectively. In this preferred form, the surfaces 38*e*-1 and 38*e*-2 have a semi-circular cylindrically curved surface extending in a 180° curve. It is evident that these two surfaces 38*e*-1 and 38*e*-2 do not necessarily have to be a continuous cylindrically curved surface, but could be made up, for example, of a plurality of transversely extending support bars or rods that would collectively define the curved support surface.

The support and shipping assembly 14*e* comprises two side support frames 110, with these support frame sections 110 being positioned on opposite sides of the assembly 14*e*, and each section 110 aligned generally in a plane which is parallel to the longitudinal axis 100 and the vertical axis 102.

These two support frame sections 110 are spaced from one another by a distance slightly greater than the transverse dimension of the belt section 16 and can be substantially identical to one another. The entire assembly 14*e* can be considered in term of structural function as having first and second end sections 112 and 114, respectively, and a middle section 116. In like manner, each support frame section 110 can be considered as having a first frame end section 118, and second frame end section 120 and a center frame section 122.

To describe now each of the frame sections 110, there is a longitudinally aligned center plate or beam 124 extending between the first and second transverse axis locations 106 and 108. This center plate 124 connects at each of its ends to an upwardly extending arm 126 and a downwardly extending arm 128. Upper and lower diagonal struts 130 and 132 extend between the outer ends of their related upper and lower arms 126 and 128 and connect at respective center locations 134 and 136 to the center plate 124. There are upper and lower longitudinally extending beams 138 and 140, respectively, and each of these beams 138 and 140 extend longitudinally outwardly at 142 and 144, respectively, beyond the upper and lower arms 126 and 128.

Each frame end section 114 and 120 comprises a longitudinally and outwardly extending arm 146 which extends to, and connects to, a vertically aligned end arm 148. The upper end of each end arm 148 connects to a diagonal member 150 which extends upwardly to connect to the outer end of the upper extension 142 or the member 138. In like manner, there is a lower diagonal member extending from the lower end of the arm 148 to connect to the end extension 144 of the lower member 140.

It can readily be seen that each frame section 116 comprises a unitary support structure. The two frame sections 116 are interconnected to one another by the end support members **36*e*-1 and 36*e*-2 and other support structure, as needed extending between the two side beams or plates 124. The transversely extending interconnecting support structure has sufficient strength and rigidity to maintain the position of the two frame sections 116 so that the plane of each frame section 116 remains perpendicular to the transverse axis 106, and thus transverse to the two end support sections 36*e*-1 and 36*e*-2**.

At the center of each plate or beam 124, there is a transversely extending through opening 154 to receive a shaft 28 by which the support structure **14*e* with the belt section wound thereon can be lifted. It can be seen that the opening 154 for each frame section 116 has a non-circular configuration (in this instance a square configuration) and the shaft 38*e* has a matching square configuration so that in addition to supporting the frame sections 110, the shaft 38*e* can be rotated to cause rotation of the spool assembly 14*e* the transverse center axis 104**.

Figure 11:
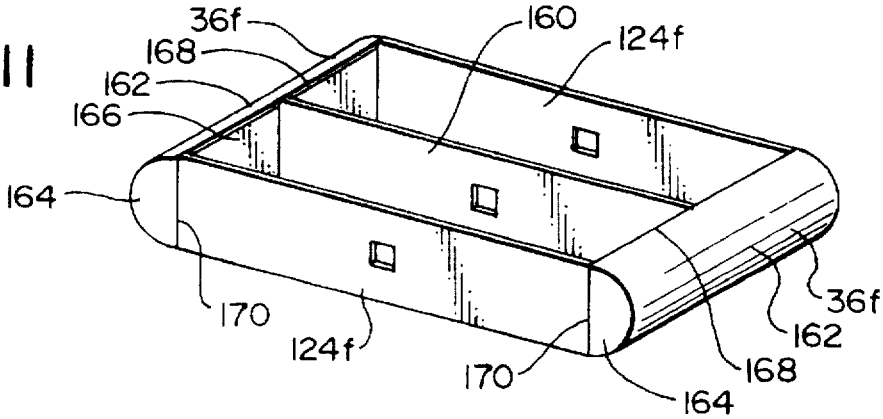
FIG. 11 is an isometric view of the main support portion of a sixth embodiment of the present invention.

A sixth embodiment of the present invention is shown in FIG. 11. Components of this sixth embodiment which are similar to components previously described will be given like numerical designations, with an "f" suffix distinguishing those of this sixth embodiment. There are two end support members **36*f* which are joined to one another by a pair of side plates or beams 124*f*. There is also a center support plate 160 positioned midway between the two side plates 24*f* and parallel to these plates 24*f*. The two end support members 36*f* each have a semi-circular cylindrical surface portion 162, and there are two semi-circular end plates 164 fixedly connected to the ends of each support member 36*f*. Also, there is a transverse plate 166 connected to the side edges 168 of each support member 36*f* and also connected to the straight edge 170 of each related end plate 164**.

It is to be understood that in FIG. 11, there is only shown the basic support structure of the spool assembly **14*f*, and that laterally extending side frames or walls could be added to extend upwardly, downwardly, and in a forward/rearward direction to contain the belt 16 as it is wound on to the assembly 14*f***.

Figure 12:
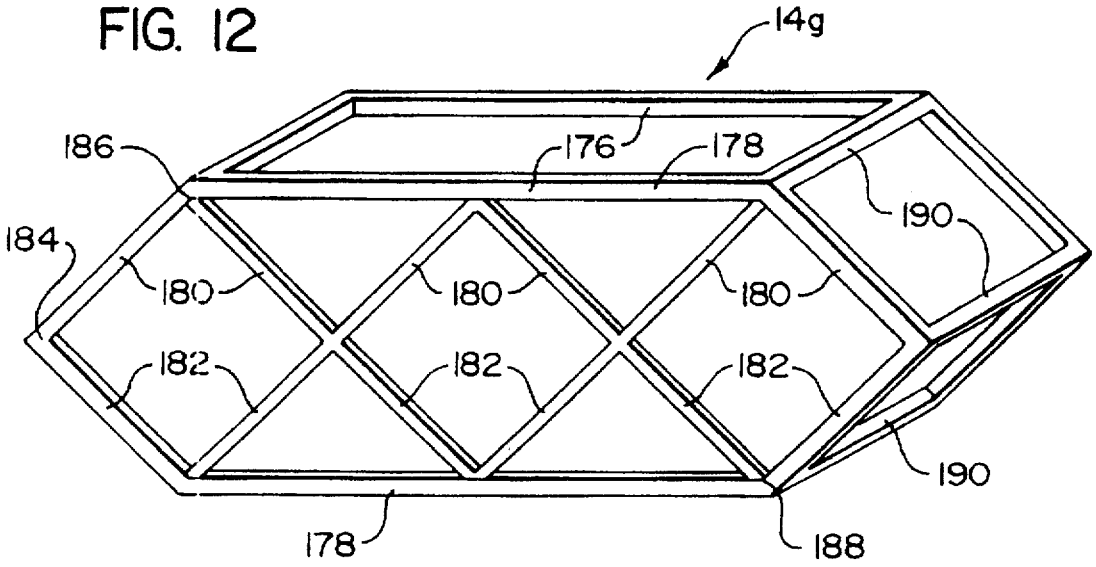
FIG. 12 is an isometric view of a support portion of a seventh embodiment of the present invention.

A seventh embodiment of the present invention is shown in FIG. 12. Components of this seventh embodiments which are similar to components previously described will be given like numerical designations with a "g" suffix distinguishing those of this seventh embodiment.

The spool assembly **14*g* comprises two side frames 176. Each side frame 176 comprises upper and lower longitudinally extending beams 178. Each pair of upper and lower beams 178 are interconnected by six upper diagonally extending struts 180, and six lower diagonal struts 182 connected to the upper struts 180. Also, each of three pair of upper struts 180 meet at an upper location 186 where they join to the upper bar 178. Each adjacent pair of lower struts 182 meet at a lower juncture location 188 at the lower longitudinal beam 178. Thus, each adjacent pair of upper struts 180 makes with the two struts 182** immediately below a truss like structure having diamond shaped truss components.

FIG. 12 simply shows the basic structure of the spool assembly **14*g*. It is to be understood that the two frame sections 176 are interconnected by transversely extending connecting beams, with three of these being shown at 190. Also, for ease of illustration, the arms or struts 180 and 182 for the frame section 176 that appears furthest from the viewer in FIG. 12** are not shown.

There are a number of significant advantages provided by the present invention. As indicated previously, it is common in the prior art to wind the belt sections around a cylindrical spool in a spiral pattern. Then these wound spools are loaded onto flatbed trucks (or some other vehicle or trailer) to be carried to other locations. Also, these belt sections are often transported by ships and are loaded into and stored in the hold of the ship.

It has to be recognized that in shipping the belt sections, there are restraints that are placed on the total weight that is being shipped, and also on the dimensions of the load being shipped (both as to height and to length). Further, there are safety considerations as to how the load can be stored, shipped, and also restrained when being shipped. In commenting on the benefits of the present invention, reference will be made to the more preferred embodiment shown in FIG. 10.

Attention is first directed toward the safety considerations, particularly when the spool assembly **14*e* with the belt section 16 wound thereon is being shipped. The two lower support beams 140 provide a substantially flat support surface having substantial length and width. This inhibits the tipping of the support structure with its load (i.e. the belt section 16). Thus, when this is placed on a flatbed trailer or a truck, it is much easier to restrain the load. Also, when this is placed in the hold of a ship, and the ship is rolling in the ocean waves, this would inhibit the tipping and sliding of the load. This is in contrast to the more common prior art method of shipping the belt section 16** on cylindrical spools which are susceptible to rolling.

Another consideration is shipping cost. When a load is being shipped in a situation where it is stored with other cargo, the volume which the load occupies is usually calculated in terms of the volume of the rectangular right prism occupied by the that load. In simpler terms, each load is considered as being a square or rectangular box occupying that space, even though the configuration of that container or the load may not be totally that of a rectangular prism. An analysis of the quantity of the belt section 16 that can be stored with the present invention indicates that a greater volume of the belt 16 can be stored in a given volume in comparison with the belt being wound on a cylindrical spool, or the belt being wound in spiral fashion on two separate spools (in a manner of a tape cassette where the two ends of the belt section are each wrapped in spiral fashion around a related spool).

Another benefit of the present invention is that when the belt section 16 is being shipped by the support structure 14e of the present invention, the weight limit can be varied (and more precisely controlled) by selecting the proper dimensions of the support structure 14e. For example, let us take the situation where the belt is wound on cylindrical spools in accordance with the prior art. One of the cylindrical prior art spools, with the belt thereon, may be only two/thirds of weight limit permitted for the truck on which it is being loaded. Yet if two loaded spools are loaded on the truck, this would be beyond the weight limit. On the other hand with the present invention, the lengthwise dimension of the support structure 14e can be selected so that the quantity of belt 16 wound onto the structure 14e can more closely match the weight limit. This is particularly advantageous where in addition to the weight restrictions there are the height restrictions. By increasing the lengthwise dimension, the weight of the load could be increased closer to the limit, while not exceeding the height restrictions.

A further consideration is that the weight restrictions in certain areas may differ, depending upon whether the load is a divisible load or a load which can be separated. For example, if the item being shipped cannot be conveniently divided into separate sections (e.g. a total machine being shipped), then the weight of the load can be increased within certain limits beyond what is the normal weight limit. In the instance where two or more belt sections are being shipped on spools, this constitutes a divisible load, and thus would come in within the lower weight limit. On the other hand, with the present invention where the support structure 14e is a unitary structure with the belt wound thereon, this would be considered one load and then be within the other weight limit for a unitary load.

Also, there is a consideration of the capacity of the crane or other means which is used to lift the support structure 14e with the belt 16 thereon. This crane may have a maximum weight limit beyond which it cannot lift the load. If this is known, then the dimensions of the support structure and also the length of the belts sections 16 can be selected to more closely match the capacity of the crane.

A further quite significant advantage of the present invention is that with the various dimension, weight and shipping restrictions that exist, with the present invention the support structure 14e can be optimized so that the maximum continuous length of the belt section 16 can be achieved. As indicated previously, for practical reasons it is usually necessary to ship separate belt sections to the use locations, where these belt sections are spliced together. Splicing two belt sections (particularly when these are large conveyor belts such as used in mines or the like, is an expensive and time consuming operation. First, it is labor intensive, and the cost for each splice could be between two and one half thousand dollars to twenty five thousand dollars. Also, a splice kit is required, and this could cost in the neighborhood of one to five thousand dollars. Beyond the cost of the splice, there are also safety considerations. The locations of the splice are the more likely locations where the belt might break or rupture. If more splices can be eliminated, this reduces the risk.

Also, if the spool 14e with the belt 16 thereon is being shipped on a flatbed truck or the like, in addition to the weight restrictions, there are also height and length restrictions. The length of the spool assembly 14e can be selected so that with the belt 16 being wound thereon, it can come just within the length restrictions that exist for that particular locality. Also, where there are height restrictions, it would be possible to place one continuous length of belt onto the spool 14e of the present invention and have a lower overall height than if the belt were wound on a conventional spool.

Figure 13:
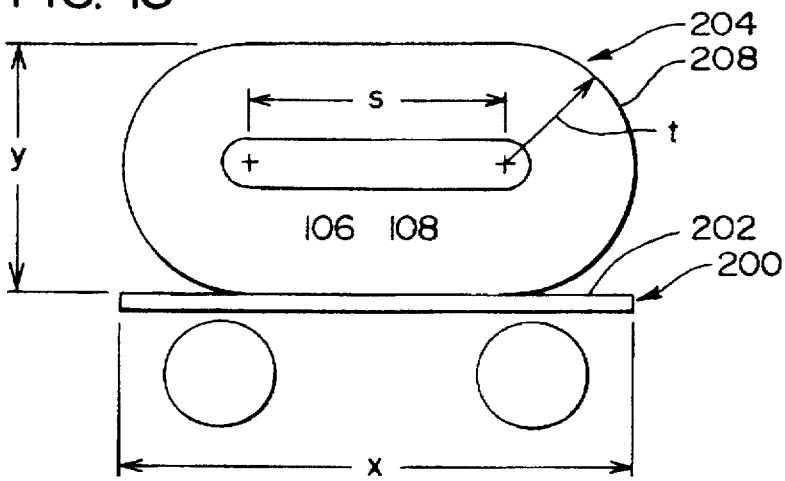
FIG. 13 is a somewhat schematic side elevational view illustrating a belt section wound on the middle part of a support assembly, this resting on the bed of a vehicle.

To illustrate the manner in which the present invention can be used advantageously to meet shipping restrictions, reference is made to FIG. 13, where there is shown schematically at 200 a wheeled shipping vehicle. For purposes of analysis, let us consider that this shipping vehicle 200 has an upper support surface 202, and that the support structure 14 with the belt 16 wound thereon comprises a shipping unit 204. Let it further be assumed that this vehicle 200 has a maximum length load dimension "x", and a maximum load height dimension "y" measured from the support surface 202 and extending upwardly to the maximum height of the shipping unit 204.

So that the shipping unit 204 can properly be within the length and height restrictions "x" and "y", two dimensions are considered. First, there is a depth winding dimension "t" which is measured from each of the transverse center axes 106 and 108 outwardly to an outside surface 208 of the belt length 16. Second, there is the spacing distance "s" between the two transverse center axes 106 and 108.

The belt winding thickness dimension "t" is selected so that "2t" is no greater than the maximum height load distance "y". The spacing distance "s" between the two transverse center axes 106 and 108 is selected so that "s" plus "2t" is no greater than "x".

In the embodiment shown in FIG. 10, the belt length 16 would usually be wound onto the support structure 14e so that it would not extend above the upper beam members 138 and would not extend below the lower frame member 140. Further, it would normally not extend beyond the two end frame members 148. Thus, the support member 14e can be constructed so that the spacing between the end members 148 would be no greater than "x" and the vertical spacing between the members 138 ands 140 would be no greater than the vertical dimension "y". Specifically, the positioning of the transverse center axes 106 and 108 would be selected to meet the requirements that "s" plus "2t" is no greater than "x", and "2t" is no greater than "y".

Figure 14:
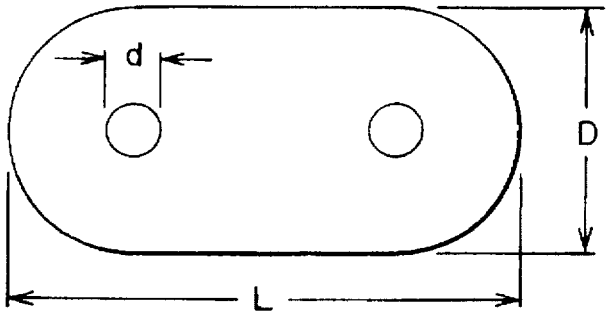
FIG. 14 is a semi-schematic side elevational view of a belt length wound in accordance with the present invention, and designating the diameters used in calculating the manner in which the present invention is utilized.

The manner in which the present invention can be implemented in a practical situation will be described below with reference to FIG. 14. In FIG. 14, there is shown somewhat schematically the belt being wound in accordance with the present invention. The overall length dimension is indicated at "L", and the load depth dimension is indicated at "D". The designation "d" indicates the diameter of the curved support surface of the end support members about which the inner layer of the belt is wound.

Let it be assumed that the belt is to be shipped on a land traveling vehicle, such as a flatbed trailer, where there are restrictions on the length of the load "L", on the transport height "D" and also on the maximum weight of the load. Also, there is the smallest diameter about which that particular belt length can be wound (designated "d"), and there is the belt thickness "T". The belt thickness and the "d" dimension will be dictated by the design of the belt.

The first step is to calculate the maximum belt length which would be permitted to be carried by the land vehicle (e.g. a lowboy trailer) in accordance with the transport length "L" and transport height "D". This is calculated in accordance with the following formula.

$$\frac{(D^2-d^2)}{4T}\pi+\frac{(L-D)\times(D-d)}{T}=\text{Maximum Belt Length}$$

The calculated maximum belt length is that length of belt which could be shipped within the "L" and "D" shipping limits, without regard to weight. Also, it should be kept in mind that appropriate factory tolerances for the constants should be considered. For example, the thickness of the belt may be specified at a certain dimension, but within the permitted tolerances, that thickness dimension may be slightly larger than what is specified. Accordingly, this must be taken into consideration in applying the formula.

After the belt length is calculated, the next step is to calculate the weight of the belt length. First the weight of the cables will be calculated in accordance with the number of cables, their length, diameter and weight per unit of volume. Then the weight of the rubber body of the belt would be calculated in accordance with its weight per unit volume times the overall volume of rubber for that belt length.

With regard to calculating the weight of the belt, there are reasonably well established standards in the industry which can be applied. Accordingly, it is believed not to be necessary to repeat these in this text.

Then it has to be determined whether the weight is more than what is allowed by the shipping restrictions, or is more than what could be handled by the crane which is to lift the belt length and the support structure on which the cable is wound. If its weight is beyond the allowable limit, then it is necessary to return back to the first step and to modify the "D" and/or "L" dimensions to arrive at a wound cable configuration which would still be within the "D" and "L" limits and meet the weight restriction.

After these calculations have been worked through so that the dimension and weight limits have been satisfied, the third step is to calculate the center distances of the end support members of the support structure. This is done simply by subtracting "D" from "L" in accordance with the following formula.

L−D=spacing of center axes of end support members

Then the support member 14 is constructed in accordance with the dimensions specified above.

There are a number of general factors which give some guidelines, and those which are considered to be more significant are listed below.

a. As the steel/rubber ratio increases, the belt weight increases.

b. As the belt width increases, the belt weight per unit length increases.

c. With regard to the length to depth ratio (L/D), let us use a two to one ratio as a base line.

i. the ratio of an L/D would generally be less than two to one where the width of the belt is at least 1500 mm or greater and there is a high steel to rubber ratio (High SRR);

ii. the L/D ratio will be approximately 2 to 1 if the width of the belt is about 1500 mm and there is a low SSR ratio. Also, the L/D ratio will be about 2 to 1 if the belt width is about 1000 to 1500 MM with a high SRR;

iii. the L/D ratio will usually be over 2 to 1 if the belt widths are under 1500 MM and there is a low SRR.

Also, the rubber thickness must be taken into consideration in evaluating the above factors.

d. The general ranges of the various values in the formulas given above will be as follows:

i. the small diameter "d" is usually between about 0.5 and 1 meter (this depending on such things as belt thickness, the diameter of the steel and the diameter of the steel cables and other factors that affect the amount of bending the belt will tolerate);

ii. the large diameter "D" is usually between about 3 meters and 4.5 meters;

iii. the maximum length "L" is usually between about 4 meters and 8 meters;

iv. the belt thickness "T" is usually between about 10 millimeters and 60 millimeters;

v. the maximum weight of the belt length "W" is usually between about 10 tons to 50 tons (this depends not only on shipping restrictions, but also the capacity of the crane which needs to lift the wound belt. Most cranes cannot handle a load over 50 tons.).

e. The present invention is ideal for fabric belts which generally have a lower density.

It is to be understood various changes or additions could be made to the present invention without departing from the basic teachings thereof.

What is claimed is:

1. A method of winding, shipping and unwinding a belt length of a conveyor belt having a width with a predetermined width dimension, a thickness of a predetermined thickness dimension, and being made of a hard moderately flexible rubber or rubber like material with longitudinally extending reinforcing cables therein, said method comprising:

a. providing a belt support structure having a longitudinal axis and comprising:

i. a first end section at a first end of said support structure having a first transverse center axis and having a first end support portion defining a first belt support area that extends around said first transverse center axis in approximately a 180° curve;

ii. a second end section at a second end of said support structure having a second transverse center axis and having a second end support portion defining a second belt support area that extends around said second transverse axis in an approximate 180° curve;

iii. a longitudinally aligned intermediate section extending between and interconnecting said first and second end sections and defining upper and lower belt support areas generally parallel to said longitudinal axis;

iv. said first, second and intermediate sections of the support structure collectively defining a continuous belt winding path;

v. said belt support structure having side sections on opposite sides of said belt winding path and spaced from one another to contain said belt on said winding path;

b. rotating said belt support structure about an axis of rotation relative to the belt length to wind the belt length along the belt winding path onto said belt support structure, where said belt winding path comprises:

i. a first end path section extending in an approximate 180° curve around said first belt support area;

ii. a second end path section extending in an approximate 180° curve around said second belt support area;

iii. an upper intermediate path section extending along said upper belt support area generally parallel to said longitudinal axis between upper ends of said first and second path sections;

iv. the lower intermediate path section extending along said lower belt support area generally parallel to said longitudinal axis between lower ends of said first and second path sections;

with said two side sections receiving and aligning said belt length therebetween, and with said belt length being contained within said side sections;

c. Shipping said belt structure with the belt length wound thereon to another location by a shipping means that has length and height shipping restrictions, wherein a maximum length of said shipping restrictions is "x", and a load depth dimension to meet said height shipping restrictions is "y", said method further comprising providing said support structure so that the first and second transverse center axes are spaced from one another by a predetermined distance, and said belt length is wound onto said support structure to a predetermined winding depth measured from said first and second transverse center axes radially outwardly, in a manner that said belt length and said support structure, forming a shipping unit, have length and height dimensions within said shipping limits, wherein said winding depth measured from said transverse axes, is "t", and said distance between said first and second transverse axes is "s", said winding depth is selected so that "2t" is between about three meters to four and one half meters and no greater than "y", and said spacing distance "s" is selected so that "s" plus "2t" is no greater than x and is between four to eight meters;

d. Unwinding said belt length from said belt support structure.

2. The method as recited in claim 1, wherein said belt length is a belt section of said conveyor belt, and plurality of said belt lengths are wound onto respective belt support structures, said method further comprising moving said belt lengths wound on their respective support structures to said another location, unwinding said belt lengths from their respective support structures, and then connecting said belt lengths to one another to form the conveyor belt.

3. The method as recited in claim 1, wherein said belt length is wound onto said belt structure by mounting said belt support structure to a winding apparatus for rotation about an axis of rotation extending transversely to said belt support structure, and said belt support structure is rotated about said axis of rotation while said belt support structure is mounted to said winding structure.

4. The method as recited in claim 1, wherein said belt length is unwound from said support structure by mounting said belt support structure to an unwinding apparatus for rotation about an axis of rotation extending transversely to said belt support structure, and said belt support structure is rotated about said axis of rotation while said belt support structure is mounted to said unwinding structure.

5. The method as recited in claim 1, wherein said support structure with said belt length wound thereon comprises a shipping unit, and said shipping unit has lower support surface means extending both longitudinally and transversely across said shipping unit to provide a substantially planar support surface, said method further comprising placing said shipping unit on a support surface of a shipping apparatus, in a manner that said planar support surface rests on the support surface of the shipping apparatus.

6. The method as recited in claim 5, wherein said side sections comprise a pair of side frame sections which extend along said belt winding path said method further comprising containing said belt length at least partially within portions of said side frame sections, with said side frame sections providing at least in part said support surface means.

7. The method as recited in claim 1, wherein at least one of said first and second end sections has its related end support portion adjustable longitudinally so that a distance between said first and second transverse center axes can be adjusted, said method further comprising positioning said end support portion that is adjustable to provide a desired spacing distance between said first and second support section.

8. The combination of a belt support structure for winding and shipping a length of conveyor belt having a section of conveyor belt wound thereon, said conveyor belt having a width with a predetermined width dimension and being made of a hard moderately flexible rubber or rubber-like material with reinforcing cables therein, said support structure having a longitudinal axis, a transverse axis, and a vertical axis, said support structure comprising:

a. a first end section at a first end of said support structure having a first transverse center axis and having a first end support portion defining a first belt support area that extends around said first transverse axis in an approximate 180° curve;

b. a second end section at a second end of said support structure having a second transverse center axis and having a second end support portion defining a second area that extends around said transverse axis in an approximate 180° curve;

c. a longitudinally aligned intermediate section extending between and interconnecting said first and second end sections, and defining upper and lower belt support areas, generally parallel to said longitudinal axis;

d. said first, second and intermediate sections of the support structure collectively defining a continuous belt winding path comprising:

i. a first end path section extending in an approximate 180° curve around said first belt support area;

ii. a second end path section extending in an approximate 180° curve around said second belt support area;

iii. an upper intermediate path section extending along said upper belt support area generally parallel to said longitudinal axis between upper ends of said first and second cross sections;

iv. a lower intermediate path section extending along said lower belt support area generally parallel to said longitudinal axis between lower ends of said first and second path sections;

e. said support structure having side sections on opposite side of said belt winding path and spaced from one another to contain said belt on said winding path; whereby said belt length can be wound onto the support structure in continuous layers around the belt winding path, and also unwound from said support structure;

f. said support structure being particularly adapted to be shipped by shipping means that has length and height shipping restrictions, the first and second transverse center axes being spaced from one another by a predetermined distance, such that with said belt length being wound onto said support structure to a predetermined winding depth measured from said first and second transverse center axes radially outwardly, so that the belt length and the support structure, forming a shipping unit, have length and height dimensions within said shipping limits, a maximum length of said shipping restrictions is "x" and a load depth dimension to meet said height shipping restrictions being "Y", said winding thickness, measured from said transverse axes being "t", and said distance between said first and second transverse axes being "s", said winding thicknesses being selected so that "2t" is no greater than "y" and so that said spacing distance "s" is selected so that "s" plus "2t" is no greater than "x".

9. The structure as recited in claim 8, wherein said first end section, said second end section, and said intermediate section are rigidly interconnected with one another to provide a substantial unitary support structure.

10. The support structure as recited in claim 8, wherein said support structure is provided with connecting means at a central area of said support structure to engage lifting means and to permit said support structure to be rotated about a winding axis of said support structure at said central area of said support structure.

11. The support structure as recited in claim 10, wherein the connecting means comprises opening means to receive said lifting means.

12. The support structure as recited in claim 8, wherein said support structure comprises side frame sections extending on opposite sides of said belt winding paths so as to be positioned on opposite sides of the belt length wound on the support structure.

13. The support structure as recited in claim 12, wherein said two frame sections comprise at least in part a truss like structure.

* * * * *